United States Patent [19]

Hatagishi

[11] Patent Number: 5,030,143

[45] Date of Patent: Jul. 9, 1991

[54] WIRE INSULATOR PRESSURE-CUT CONNECTOR TERMINAL

[75] Inventor: Yuji Hatagishi, Shizuoka, Japan

[73] Assignee: Yazaki Corporation, Japan

[21] Appl. No.: 521,525

[22] Filed: May 10, 1990

[30] Foreign Application Priority Data

May 25, 1989 [JP] Japan ..... 1-59664[U]

[51] Int. Cl.[5] ..... H01R 4/48

[52] U.S. Cl. ..... 439/861; 439/395; 439/397

[58] Field of Search ..... 439/877, 879, 861, 891, 439/391–407, 417, 418, 419, 845, 849, 850, 858

[56] References Cited

U.S. PATENT DOCUMENTS

| | | | |
|---|---|---|---|
| 2,104,786 | 1/1938 | Andre | 439/879 |
| 3,320,574 | 5/1967 | Tuchel | 439/850 |
| 4,593,963 | 6/1986 | Endo et al. | 339/97 |
| 4,699,441 | 10/1987 | D'Urso et al. | 439/397 |
| 4,863,400 | 9/1989 | Sato | 439/400 |
| 4,932,891 | 6/1990 | Spanke | 439/395 |

FOREIGN PATENT DOCUMENTS

| | | |
|---|---|---|
| 585288 | 6/1981 | Japan . |
| 6372856 | 10/1986 | Japan . |
| 61-202877 | 12/1986 | Japan . |

*Primary Examiner*—David L. Pirlot

*Attorney, Agent, or Firm*—Wigman & Cohen

[57] ABSTRACT

The wire insulator pressure-cut connector terminal comprises a base plate formed integral with at least one cutter plate portion with a cutting open slot and a first terminal contact end portion, and a terminal box formed integral with a partially U-shaped section housing portion for housing the base plate and a second terminal contact end portion for constructing a female terminal contact end portion in cooperation with the first terminal contact end portion of the base plate. Since the base plate formed with the cutter plate portion and the terminal box formed with the terminal contact end portion are made of different materials with different thicknesses, respectively, it is possible to freely provide a sufficient rigidness for the cutter plate and a preferable elasticity for the terminal contact end, independently, according to the diameter and the material of the wire insulator.

8 Claims, 3 Drawing Sheets

WIRE INSULATOR PRESSURE-CUT CONNECTOR TERMINAL

BACKGROUND OF THE INVENTION

1. Field of the Invention

The present invention relates to an insulator pressure-cut connector terminal for connecting a core conductor of a wire to a connector terminal by pressure-fitting the wire into at least one insulator cutting open slot formed in a cutter plate of the connector terminal, without stripping the insulating cover material from the wire, and in particular to an insulator pressure-cut connector terminal suitable for use in connecting a large- or small-diameter wire thereto.

2. Description of the Prior Art

Recently, wire insulator pressure-cut connector terminals (referred to as pressure-cut terminals, hereinafter) have been widely used to improve the productivity in the assembly process of automotive vehicles, for instance, because insulator covered wires (referred to wires, hereinafter) can be connected to the pressure-cut terminal by simply pushing the wire to at least one slot for cutting the wire insulator in such a condition that the core conductor of the wire is securely brought into contact with the slot formed in a cutter plate of the pressure-cut terminal.

FIG. 1 shows an example of the prior-art pressure-cut terminals, which roughly comprises a base plate 1, a female connector portion 2, and an insulator pressure-cutting porting 3. In more detail, a male terminal tab (not shown) can be inserted into a space formed between the female connector portion 2 and an inwardly bent spring portion 8. The insulator pressure-cutting portion 3 is formed into a box shape having two opposing wire cutter plates 4 and 5 formed with an insulator pressure-cutting open slot 6 or 7, respectively. In this pressure-cut terminal, when the insulated wire is fitted into these pressure-cutting open slots 6 and 7, the insulating cover thereof is cut off and therefore the core conductor is brought into direct contact with the insulator pressure-cutting portion 3, so that it is possible to improve the productivity of the connecting work of the wire to the connector terminal.

In the above-mentioned prior-art pressure-cut terminal, however, there exists a following problem: when a relatively large diameter wire is pressure fit into these cutting open slots 6 and 7, the two opposing cutter plates 4 and 5 are easily deformed and therefore the wire conductor contact reliability is not high. To overcome the above-mentioned problem, when the thickness of the pressure-cut plates 4 and 5 is increased, there causes another problem in that the elastic force of the spring portion 8 is excessively increased so that it is rather difficult to engage the male terminal tab (not shown) with the female connector portion 2.

To overcome the above-mentioned problem, the same applicant has already proposed a pressure-cut terminal in which the insulator pressure-cutting portion is formed by a relatively thick plate and the female connector portion is formed by a relatively thin plate integral with the insulator pressure-cutting portion 3, as disclosed in U.S. Pat. No. 4,593,963. In this prior-art terminal, however, since a plate material having two different thicknesses must be prepared, there exists another problem in that the material cost inevitably increases.

To overcome the above-mentioned problem, another pressure-cut terminal 10 as shown in FIGS. 2(A) and (B) has been proposed, which comprises: a flat box-shaped female terminal end 11, a U-shaped section wire connecting portion 12, and a separate cutter plate 14 formed with a downward extending cutting open slot 14*a*. In this terminal, a wire 13 is inserted into the wire connecting portion 12 and then the cutter plate 14 is pushed from above into the U-shaped section wire connecting portion 12 so that the cutter plate 14 can be fixed to the wire connecting portion 12. In this prior-art pressure-cut terminal, since two lower knife portions 15 of the cutter plate 14 cut the insulating cover material 16 of the wire 13, the core conductor 17 of the wire 13 can be electrically connected to the cutter plate 14.

In this case, since the thickness of the cutter plate 14 can be determined freely according to the diameter of the wire, it is possible to prevent the cutter plate 14 from being deformed by appropriately determining the thickness of the cutter plate 14 and the width of the cutting open slot 14*a* according to the diameter of the wire 13. Therefore, when a plurality of cutter plates 14 of different thickness are prepared according to the diameters of the wires 13, it is possible to reliably cut and connect the wire 13 to the cutter plate 14. Further, since the plate thickness of the terminal end 11 can be determined independently from the cutter plate 14, it is possible to easily engage a mated male terminal tab (not shown) with the female terminal end 11. In the above-mentioned prior-art pressure-cut terminal, however, since the core conductor 17 of the wire 13 is indirectly connected to the wire connecting portion 12 via the cutter plate 14, there still exists a problem in that the electrical contact stability is not sufficient and stable, because the cutter plate 14 is in contact with the wire connecting portion 12 through only partial side surfaces of the cutter plate 14 or the wire conductor 17 of the wire 13 is indirectly connected to the wire connecting portion 12 via the cutter plate 14 in the pressure-cut terminal 10.

SUMMARY OF THE INVENTION

With these problems in mind, therefore, it is the primary object of the present invention to provide a wire insulator pressure-cut connector terminal high in both electrical and mechanical connection reliability by determining an appropriate thickness of the cutter plate for providing a sufficient rigidness and another different thickness of the terminal contact end for providing an appropriate elasticity.

To achieve the above-mentioned object, the wire insulator pressure-cut connector terminal, according to the present invention, comprises: (a) a base plate (21) formed integral with at least one cutter plate portion (23, 24) with a cutting open slot (23*a*, 24*a*) and a first terminal contact end portion (21*a*), the cutting slot cutting an insulating cover of a wire pressure-fitted thereinto so that a wire conductor is brought into contact with said base plate; and (b) a terminal box (22) formed integral with a housing portion (25, 26) for housing said base plate in contact with said base plate and a second terminal contact end portion (28) for constructing a female terminal end portion in cooperation with the first terminal contact end portion (21*a*) of said base plate.

When the thickness of the base plat is determined larger than that of the terminal box, the rigidity of the cutter plate portion increases so as to be suitable for a large-diameter wire and the elasticity of the second terminal contact end portion decreases so as to be suitable for engagement with another male terminal tab.

It is preferable to make the base plate of a rigid material and the terminal box of an elastic material. Further, when the cutter plate portion is formed with at least one projections (23*b*, 24*b*) and the terminal box is formed with at least one slot portion engageable with the projection of the cutter plate portion, it is possible to firmly house the base plate within the terminal box, for providing both stable mechanical and electrical contact between the base plate and the terminal box.

In the wire insulator pressure-cut connector terminal according to the present invention, since the cutter plate portion directly connected to the wire conductor is formed integral with the first terminal end portion in the base plate, it is possible to attain a stable electrical connection between the wire conductor and the terminal. Further, since the base plate formed with the cutter plate portions is housed within the partially open terminal box, it is possible to stably pressure-fit the wire into the cutting open slots of the cutter plate portions. Further, when a relatively large diameter wire is connected to the terminal, it is possible to increase the thickness of only the base plate for prevention of cutter plate deformation, while maintaining an appropriate elasticity at the second terminal contact end portion of the terminal box so as to construct a female terminal portion into which another male terminal tab can be easily inserted.

BRIEF DESCRIPTION OF THE DRAWINGS

The features and advantages of the wire insulator pressure-cut connector terminal according to the present invention will be more clearly appreciated from the following description taken in conjunction with the accompanying drawings in which.

DETAILED DESCRIPTION OF THE PREFERRED EMBODIMENTS

Figure 4B:
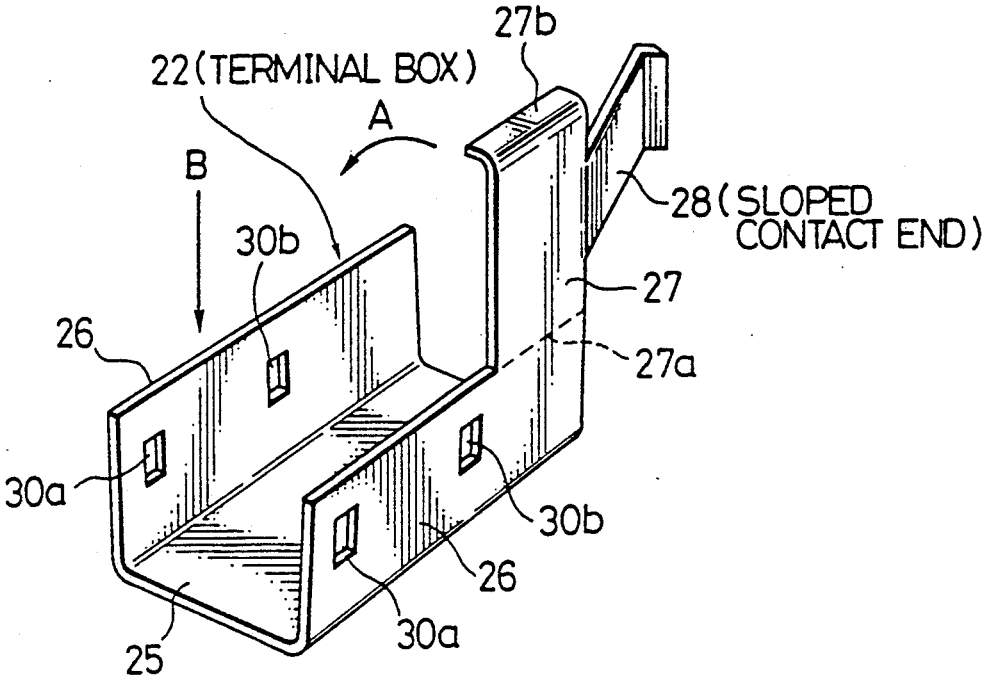
FIG. 4(B) is a perspective view showing a thin terminal box formed with a terminal contact end of the first embodiment shown in FIG. 3.
Figure 3:
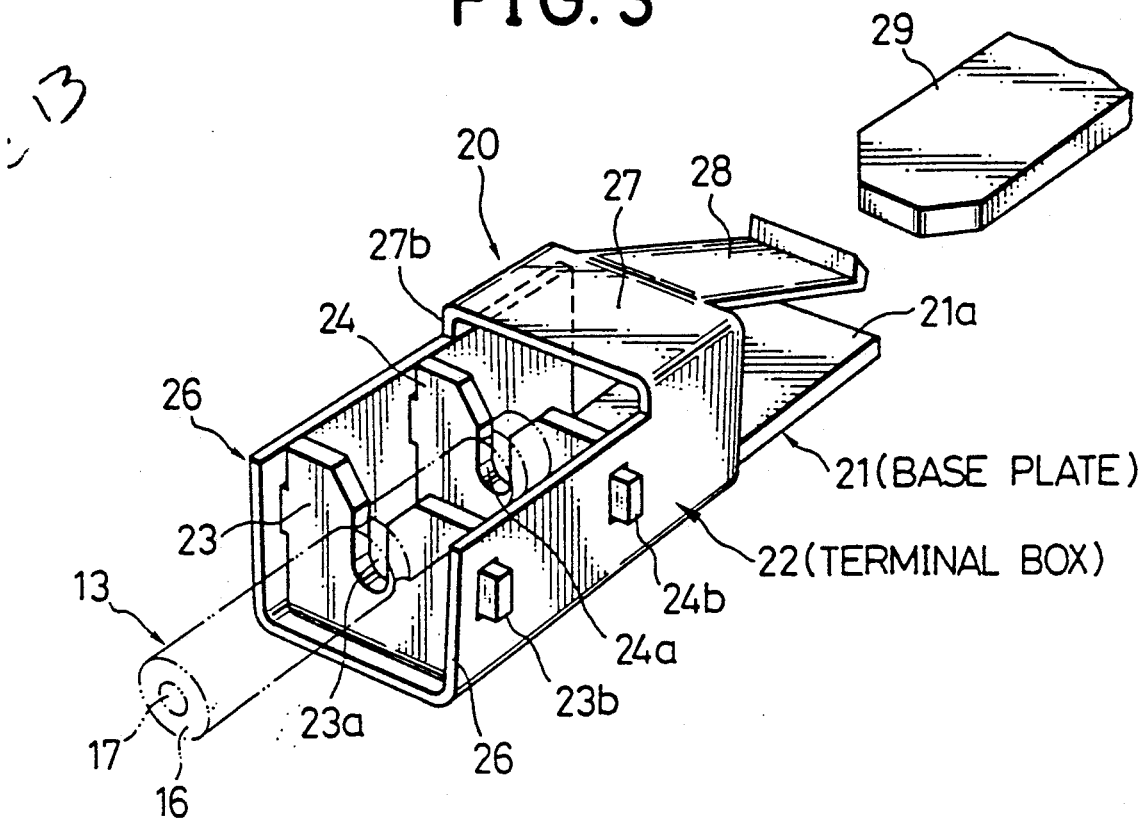
FIG. 3 is a perspective view showing a first embodiment of the wire insulator pressure-cut connector terminal according to the present invention.
Figure 4A:
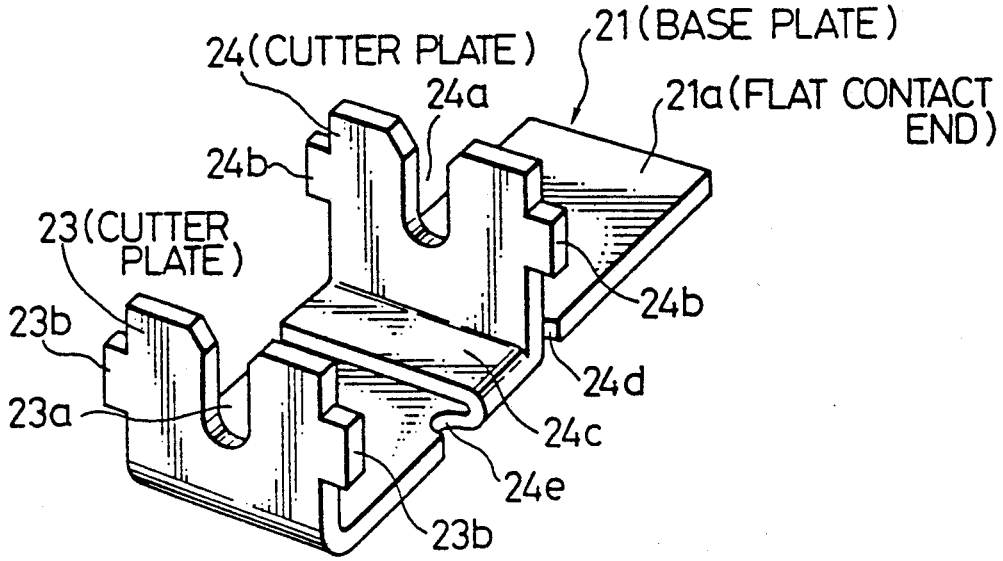
FIG. 4(A) is a perspective view showing a thick base plate formed with two cutter plates of a first embodiment of the connector terminal according to the present invention, shown in FIG. 3.

Embodiments of the present invention will be described hereinbelow with reference to the attached drawings. FIGS. 3, 4(A) and 4(B) show a first embodiment thereof.

The wire insulator pressure-cut connector terminal 20 (referred to as pressure-cut terminal, hereinafter) according to the present invention roughly comprises a thick base plate 21 formed with two cutter plate portions 23 and 24 and a first terminal contact end portion 21*a*, and a thin terminal box 22 formed with a housing portion 25 and 26 and a second terminal contact end portion 28. Each of the base plate 21 and the terminal box 22 is formed by punching out a plate material and then bending through two or three processing steps.

In FIG. 4(A), the thick base plate 21 is formed with a base plate (first) terminal contact end portion 21*a*, a first cutter plate portion 23 for pressure-cutting a wire insulator 16 of a wire 13, and a second cutter plate portion 24 for pressure-cutting the same wire insulator 16 of the same wire 13. The first cutter plate 23 is formed with a central insulator cutting open slot 23*a* and two square projections 23*b* extending outwardly from the two side surfaces thereof. The second cutter plate 24 is similarly formed with a central insulator cutting open slot 24*a* and two square projections 24*b* also extending outwardly from the two side surfaces thereof. To form the first cutter plate 23, a flat plate having a shape corresponding to a development elevation of the base plate 21 is punched out from a plate material, and an end thereof is bent at a right angle so that the first cutter plate 23 stands upright from the base plate 21. To form the second cutter plate 24, on the other hand, the flat plate is bent downward at the middle portion of the flat plate at a right angle, and thereafter a base portion 24*c* of the cutter plate 24 is bent over 180 degrees counterclockwise in FIG. 4(A) so that the inner surface of the base portion 24*c* is brought into contact with outer surface of the base plate 21. In FIG. 4(A), two semicircular cutout portions 24*d* and 24*e* serve to allow the second cutter plate 24 so as to be bent to such a position as to be arranged in parallel to the first cutter plate 23 as shown. Further, it is preferable to make this base plate 21 of a rigid conductive material.

In FIG. 4(B), the thin terminal box 22 is formed with a U-shaped section (channel) portion including a bottom portion 25 and two side walls 26, a partial box cover portion 27, and a terminal box (second) sloped contact end portion 28 extending from the cover portion 27. Each of the two side walls 26 is formed with two slots 30*a* and 30*b* in such a way that the two projections 23*b* of the first cutter plate 23 are engageable with the two slots 30*a* and the two other projections 24*b* of the second cutter plate 24 are engaged with the two other slots 30*b*, as shown in FIG. 3.

To form this terminal box 22, a flate plate having a shape corresponding to a development elevation of the terminal box 22 is punched out from a plate material; the elastic terminal box sloped contact end portion 28 and a cover end 27*b* are both bent upward from the cover portion 27 and then both side surface portions 26 thereof are bent at right angles so that the U-shaped (channel) portions 6 stand upright from the bottom portion 25. Further, it is preferable to make this terminal box 22 of an elastic conductive material.

To assemble the pressure-cut terminal 20, the thick base plate 21 is inserted into and engaged with the U-shaped (channel) portion of the thin terminal box 22 in the direction B (FIG. 4B) in such a way that the four projections 23*b* and 24*b* are engaged with the four slots 30*a* and 30*b*, and thereafter the U-shaped portion of thin terminal box 22 are closed or tightened so that the inner surfaces of the two side walls 26 are brought into tight contact with the four side surfaces of the two cutter plates 23 and 24. After the base plate 21 has been engaged with the terminal box 22, the box cover portion 27 is further bent in the direction A (shown in FIG. 4B), so that the pressure-cut terminal 20 can be assembled. Under these conditions, another male terminal tab 29 (shown in FIG. 3) can be elastically engaged with or inserted into the space formed between the sloped contact and portion 28 and the inner end surface of the terminal contact end portion 21*a* of the base plate 21. Alternatively, it is also possible to insert or engage the thick base plate 21 into or engage with the elastic U-shaped portion of the thin terminal box 22 in which the box cover portion 27 has already been bent as shown in FIG. 3.

Figure 1:
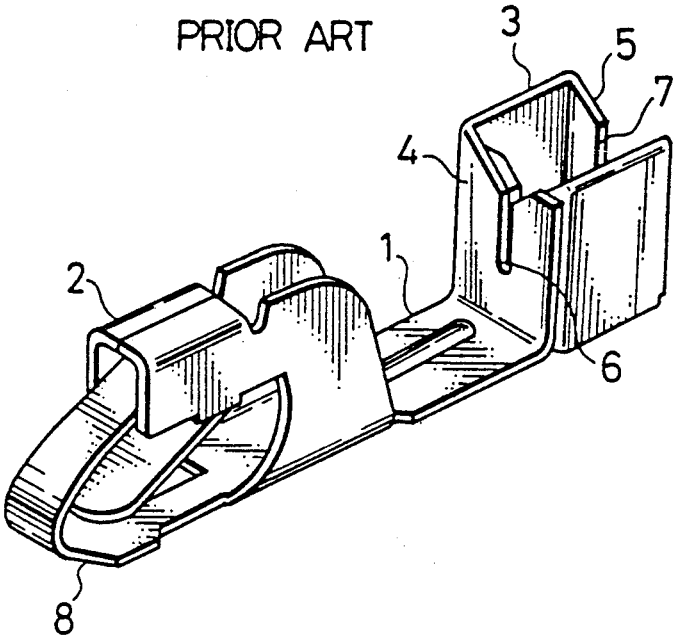
FIG. 1 PRIOR ART
FIG. 1 is a perspective view showing a first example of prior-art wire insulator pressure-cut connector terminals.
Figure 2A:
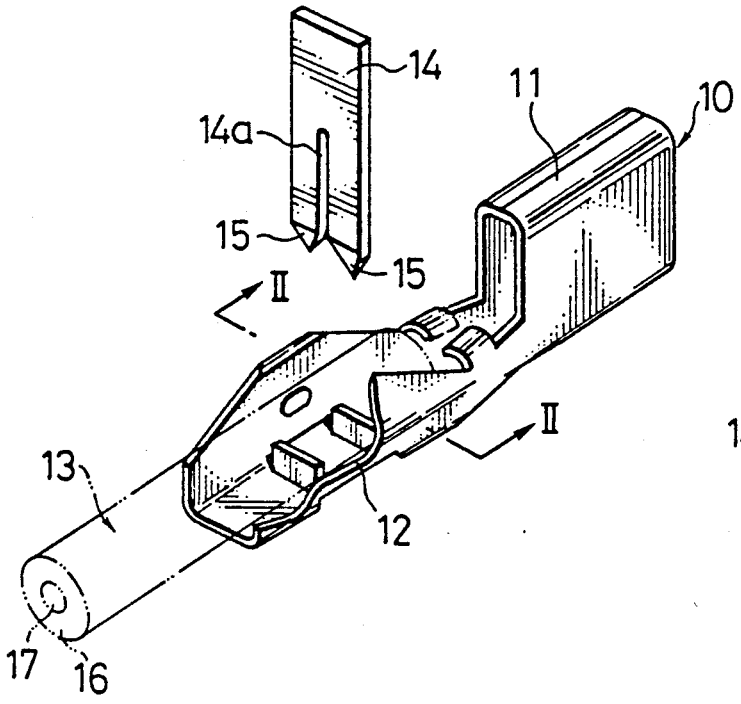
FIG. 2(A) PRIOR ART
FIG. 2(A) is a perspective view showing a second example of prior-art wire insulator pressure-cut connector terminals.
Figure 2B:
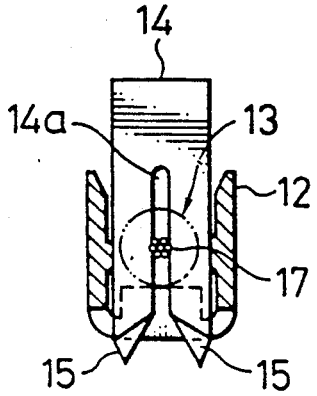
FIG. 2(B) PRIOR ART
FIG. 2(B) is a cross-sectional view taken along the line II—II in FIG. 2(A)

In the above-mentioned embodiment, a wire 13 having a core conductor 17 covered by an insulator 16 (shown in FIG. 2A) is pressure-fitted into the two insulator cutting open slots 23*a* and 24*a* of the two cutter plates 23 and 24. Therefore, the wire 13 can be easily connected electrically to the terminal 20. Further, the pressure-cut terminal 20 is connected to the male terminal tab 29 inserted into a space formed between the thick flat terminal contact end portion 21*a* of the base plate 21 and the thin sloped elastic terminal contact end portion 28 of the terminal box 22.

In the wire insulator pressure-cut connector terminal according to the present invention, since the cutter plates 23 and 24 are formed of a relatively thick material, it is possible to pressure-fit a relatively large diameter insulated wire into the insulator cutting open slots 23*a* and 24*a* formed in the two cutter plates 23 and 24 without deforming the thick cutter plates 23 and 24, thus improving the mechanical wire connection reliability at the cutter plates 23 and 24. Further, when the wire diameter is not large, it is possible to reduce the thickness of the cutter plate. On the other hand, since the female portion formed between the relatively thick flat terminal contact end portion 21*a* and the thin sloped terminal contact end portion 28 is elastically formed by the deformable contact end portion 28, it is possible to securely engage the male terminal tab 29 with the pressure-cut terminal 20, thus facilitating the male tab connection to the pressure-cut terminal.

Figure 5:
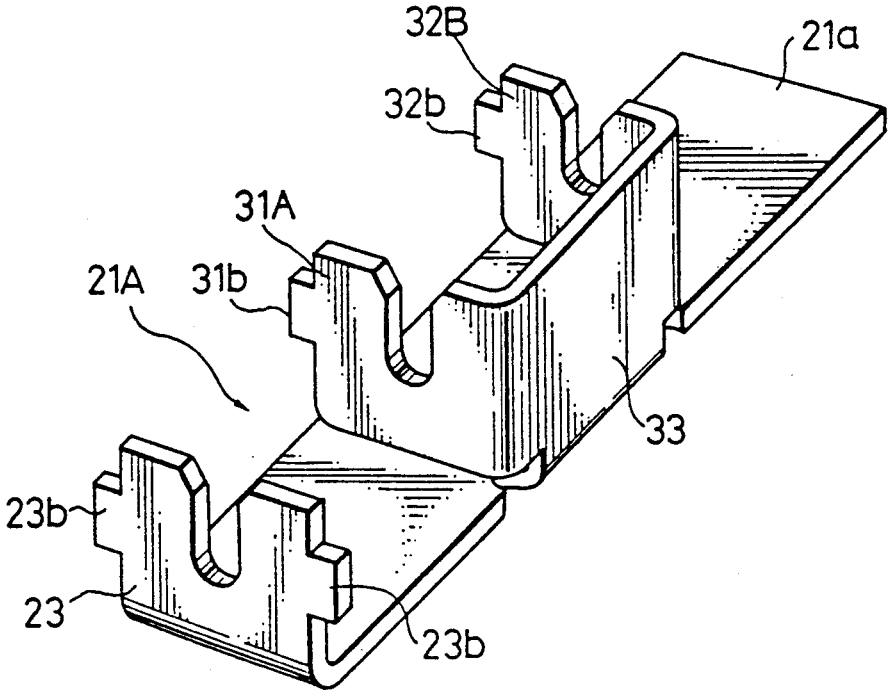
FIG. 5 is a perspective view showing a thick base plate formed with three cutter plates of another embodiment of the connector terminal according to the present invention.

FIG. 5 shows another embodiment of the pressure-cut terminal according to the present invention, in which the thick base plate 21A is formed with three cutter plates 23, 31A and 31B to further improve the electrical connection reliability between the wire conductor and the pressure cut terminal. In this embodiment, each of the cutter plate 23, 31A, and 31B is of course formed with each insulator cutting open slot. Further, without being limited thereto, it is of course possible to increase the number of the cutter plates more than three. Further, in this embodiment, since the middle two cutter plates 31A and 31B are connected by a side upright surface 33, four projections 23*b*, 23*b*, 31*b*, 32*b* are formed in the three cutter plates 23, 31A, and 31B.

In the above embodiments, the thickness of the base plate 21 is determined thicker than that of the terminal box 22. Without being limited thereto, however, when the diameter of the wire is small, these exists the case where it is preferable to determine the thickness of the base plate 21 thinner than that of the terminal box 22 in order to obtain a stable engagement between the female portion of the pressure-cut terminal (between the flat terminal contact end portion 21*a* of the base plate 21 and the sloped contact end portion 28 of the terminal box 22) and the male terminal tab 29.

Further, in the above embodiment, the terminal box is so formed as to provide a female terminal end portion between the two contact ends 28 and 21*a*. However, it is also possible to use the contact end portion 21*a* of the base plate 21 as a male contact end engageable with another female portion of another contact terminal.

As described above, in the wire insulator pressure-cut connector terminal according to the present invention, since the thickness and the material of the base plate formed with the cutter plates can be freely determined, it is possible to securely pressure-fit the insulated wire into the cutter plates without deformation thereof. Further, since the thickness and the material of the terminal box also can be determined independently, it is possible to securely engage another terminal tab with the pressure-cut terminal. In other words, it is possible to provide a sufficient rigidness for the cutter plate of the base plate and a preferable elasticity for the terminal contact end of the terminal box engageable with another male terminal tab, according to the diameter and the material of the wire insulator.

What is claimed is:

1. A wire insulator pressure-cut connector terminal, comprising:

(a) a base plate formed integral with at least one cutter plate portion with a cutting open slot and a first terminal contact end portion, the cutting slot cutting an insulating cover of a wire pressure-fitted thereinto so that a wire conductor is brought into contact with said base plate; and (b) a terminal box formed integral with a housing portion for housing said base plate in contact with said base plate and a second terminal contact end portion extending monolithically from said housing portion for constructing a female terminal end portion opposing the first terminal contact end portion of said base plate.

2. The wire insulator pressure-cut connector terminal of claim 1, wherein a thickness of said base plate is different from that of said terminal box.

3. The wire insulator pressure-cut connector terminal of claim 1, wherein said base plate is made of a rigid material and said terminal box is made of an elastic material.

4. The wire insulator pressure-cut connector terminal of claim 1, wherein said terminal box is formed into a partially open U-shaped section for providing an easy pressure-fit of the wire into the cutting open slot of said base plate.

5. The wire insulator pressure-cut connector terminal of claim 1, wherein said at least one cutter plate portion is formed with at least one projection (23*a*, 24*b*) and said terminal box is formed with at least one slot portion engageable with said projection portion of said cutter plate portion when said base plate is housed within said terminal box.

6. The wire insulator pressure-cut connector terminal of claim 1, wherein each of said base plate and said terminal box is formed by punching from a material plate each of said base plate and said terminal box and forming said base plate and said terminal box by only bending the punched out plate to provide a reliable electrical connection between the wire conductor and the connector terminal.

7. The wire insulator pressure-cut connector terminal of claim 2, wherein a thickness of said base plate is larger than that of said terminal box, for providing a rigidly strong cutter plate portion for a relatively large diameter wire and an elastically weak second terminal contact end portion.

8. The wire insulator pressure-cut connector terminal of claim 2, wherein a thickness of said base plate is smaller than that of said terminal box, for providing a rigidly weak cutter plate portion for a relatively small diameter wire and an elastically strong second terminal contact end portion.

* * * * *